US008237533B2

(12) United States Patent
Chatzopoulos et al.

(10) Patent No.: US 8,237,533 B2
(45) Date of Patent: Aug. 7, 2012

(54) INTEGRATED OR PRINTED MARGARITA SHAPED INDUCTOR

(75) Inventors: Alkiviades Chatzopoulos, Salonika (GR); Giorgos Bontzios, Salonika (GR)

(73) Assignee: Aristotle University Thessaloniki Research Committee, Thessaloniki (GR), part interest ( * ) Notice: Subject to any disclaimer, the term of this patent is extended or adjusted under 35 U.S.C. 154(b) by 23 days.

(21) Appl. No.: 12/657,376

(22) Filed: Jan. 19, 2010

(65) Prior Publication Data

US 2010/0245011 A1 Sep. 30, 2010

(30) Foreign Application Priority Data

Jan. 16, 2009 (GR) ..... 20090100028

(51) Int. Cl.
*H01F 5/00* (2006.01)

(52) U.S. Cl. ..... 336/200; 336/223; 336/232

(58) Field of Classification Search ..... 336/200, 336/223, 232
See application file for complete search history.

(56) References Cited

U.S. PATENT DOCUMENTS

| | | | | |
|---|---|---|---|---|
| 4,763,035 | A * | 8/1988 | Zeeman | 310/208 |
| 5,446,311 | A * | 8/1995 | Ewen et al. | 257/531 |
| 6,175,727 | B1 | 1/2001 | Mostov | |
| 7,071,805 | B2 * | 7/2006 | Hasegawa et al. | 336/200 |
| 7,147,604 | B1 | 12/2006 | Allen | |
| 7,999,650 | B2 * | 8/2011 | Mori | 336/200 |
| 2003/0210122 | A1 * | 11/2003 | Concord et al. | 336/200 |
| 2003/0222750 | A1 * | 12/2003 | Kyriazidou | 336/200 |
| 2008/0122568 | A1 * | 5/2008 | Yan et al. | 336/200 |
| 2009/0243389 | A1 * | 10/2009 | Edo et al. | 307/31 |

FOREIGN PATENT DOCUMENTS

EP 1304707 4/2003

OTHER PUBLICATIONS

Joshua Peters, Design of High Quality Factor Spiral Inductors in RF MCM-D, Sep. 2004, Department of electrical Engineering and Computer Science, Massachusetts Institute of Technology, Cambridge, MA.

* cited by examiner

*Primary Examiner* — Anh Mai
(74) *Attorney, Agent, or Firm* — James Creighton Wray

(57) ABSTRACT

An integrated printed inductor has a set of open petal loops, connected together in series. For a given inductance value higher quality factor and higher frequency value result using an equal chip surface area. With the same fabrication cost and equal occupied area, higher quality factor values at higher frequency can be achieved. The innovative shape is such that secondary mutual coupling effects occur and contribute to increases of overall inductance values. Small current loops arranged as petals corresponding to inductance value LO are connected in series for the inductance value to add up to a higher value. The loops are connected along a circular path to minimize the total chip area occupied. A secondary loop in the center of the inductor results in a stronger magnetic flux and a higher inductance value, due to both self inductance of the secondary loop and mutual inductance of it with the petals.

20 Claims, 15 Drawing Sheets

INTEGRATED OR PRINTED MARGARITA SHAPED INDUCTOR

This application claims the benefit of Greek Application No. 20090100028 filed Jan. 16, 2009, which is hereby incorporated by reference in its entirety as if fully set forth herein.

FIELD OF THE INVENTION

The present invention relates to the field of semiconductor devices and more specifically to an integrated inductor structure and its method of fabrication.

BACKGROUND OF THE INVENTION

Integrated inductors are widely used in microelectronics and particularly in RF integrated circuits (Radio Frequency Integrated Circuits—RFICs) and in microwave monolithic integrated circuits (MMICs). Integrated inductors are known as key devices in low noise amplifiers (LNAs). LNA is a special type of electronic amplifier used in communication systems to amplify very weak signals received by an antenna. They are also widely used in microwave systems such as GPS, due to low losses in the microwave frequency range. Typically, one or more integrated inductor devices are used to fabricate it. The operating frequency of an LNA is an important design specification and is influenced by its elements. For this reason, the inductors used in the LNAs need to be featured by a high quality factor Q, for the required inductance values L. The quality factor Q is the parameter of the inductor which characterizes its performance and is defined as the ratio of the energy of the magnetic field that can be stored in the inductor to the electric energy losses during its operation. Using the inductor parameters, the quality factor is defined as $Q=L\omega/R$, where L and R is the total inductance and resistance of the inductor and $\omega$ is the frequency at which it is measured.

Furthermore, due to the constant demand for higher frequencies of operation regarding the electronic circuits, there is a struggle to find ways to increase the bandwidth of operation of the integrated inductors. Two are the main frequency ranges of interest in the design process. Firstly, the resonance frequency, where the inductor loses its inductive properties, and secondly, the frequency of the highest quality factor value.

Another type of inductors widely used in microelectronics is the category of printed inductors which are fabricated or printed on PCBs (Printed Circuit Boards). The material which they are fabricated on is usually silicon based. Other materials such as fabric may also be used. The difference between the two types of inductors merely lies in the fabrication process. The printed inductor is fabricated on any printed circuit board (PCB), while the integrated one on an integrated chip following the rules imposed by the specific process at each case. This results in that the shape of the inductor and the design steps are in both cases the same.

Up to now, the design of integrated inductors mainly consists of connecting in series two or more inductors of single or multi-turn which are designed in the different metal layers provided by each technology. Each layer consists of a continuous spiral metal track forming the inductor turns. Different metal layers are isolated from each other by oxide layers between them. The series combination of inductors is achieved by so-called vias provided by each technology, which are vertical metal lines connecting two adjacent metal layers. The two free ends of the continuous track, formed by the inductors connected in series, are the ports of the entire inductor. The inductor design almost always starts from the top metal layer, since most of the technologies provide a special metal for this purpose, while by this way a better isolation from the substrate is achieved. In the specific case of a one layer and 2.5 turn inductor, designed at one layer, a metal track at a different layer is used, to connect the port inside the inductor, with a point outside of it. The connection of the metal line with the two connecting points is achieved by use of vias. Such a line which connects two coplanar points in general, but resides in a different—usually the lower next—layer is called underpass. Two points are connected with underpass when the direct (coplanar) connection would short circuit other points in the chip.

The main design parameters of integrated inductors comprise the outer diameter of the inductor, the width of metal tack lines and the distance between them, and the number of turns and layers.

Several methods have been reported to increase either the quality factor or the main operating frequency values of interest regarding inductors. Most of them rely on either of unconventional materials such as substrates GaAS, or the post-processing of the chip such as etching, after its fabrication introducing additional steps in the production of the chip, possibly resulting in dramatically increasing the fabrication cost.

Other methods are based on exotic technologies, such as MEMS, increasing even more the cost of the final product.

Finally, still other methods based on the existing conventional technology, such as patterned ground Shields, do not provide significant improvement due to parasitic effects such as so-called eddy currents.

For this reason there is a need to increase the quality factor and the basic operating frequency values of integrated inductors by using conventional low cost technology without introducing additional steps that would lead to an increased cost of the final chip.

PRIOR ART

The U.S. Pat. No. 6,175,727 is referring to a suspended printed inductor (SPI) and an LC-type printed filter using the said SPI. The description is mentioning only printed components on PCBs (not at all about integrated inductors) and the application is restricted to frequencies up to tenths of MHz, as it can be seen from the FIGS. 7, 8, 9. There is no relation to the GHz range of applications and not at all reference of a shape for the inductor.

EP1304707 A3 refers to a method of making multiple layer inductors. The description is mentioning only printed components on PCBs—not at all about integrated inductors—and the application is restricted to PCB as it can be deducted from the formula of the calculation of inductance L in claim 17. There is no relation to the GHz range of applications and not at all reference of a shape for the inductor.

U.S. Pat. No. 7,147,604 B1 refers to a sensor for wirelessly determining a physical property within a defined space. The said sensor is fabricated using MEM system technology and is deployed on flexible material in order to be easily entered to human body. The shape of FIG. 12 is elaborated only to lend more complex folding patterns that could facilitate delivery to specific anatomical location within an artery and has nothing to do with our technical perspective for the performance of an integrated inductor. The said shape is referred to only as a capacitor surface and nothing is mentioned on its inductive performance.

It is to be stated however that the performance of the planar integrated inductors has reached a limiting point. The most commonly used shape of integrated inductors is the octagonal which has been shown to exhibit both good overall performance and availability in all of the fabrication technologies. It is thus apparent that novel design shapes are necessary if we want to push the performance of the integrated inductors to higher level.

OBJECT OF THE INVENTION

It is an object of the invention to provide a solution to the afore-mentioned problems by introducing a new design shape using conventional low-cost technology and without the need for additional steps in the fabrication process apart from the standard ones.

The main object of the invention is thus to propose a totally innovative shape that is such that secondary mutual coupling effects occurring wherein contribute to the increase of the overall inductance value. The fundament consists in having small current loops arranged as petals, corresponding to inductance value L0, connected in series for the inductance value to add up to a higher value. The loops are connected along a circular path, which offers the substantial advantage to minimize the total chip area occupied, and even more remarkable to form a secondary loop in the center of the inductor resulting to a stronger magnetic flux and therefore to a higher inductance value, which is due to both self inductance of the secondary loop and to the mutual inductance of it with the petals.

SUMMARY OF THE INVENTION

There is thus proposed according to the invention an integrated respectively printed margarita-shaped inductor as defined in the main claim 1 hereinafter, consisting of a set open loops, the petals, which are connected together in series forming its turns.

Its advantage compared to conventional integrated inductors is that, for a given value of inductance, a higher quality factor at an even higher frequency value is provided while equal surface area is occupied on the chip. A direct consequence is that, with the same fabrication cost and equal occupied area, higher quality factor values at higher frequency can be achieved. In fact, as the proposed invention is consistent with all the conventional design rules, it can be fully integrated into all conventional technologies regarding fabrication of integrated inductors.

Additionally, all the traditional methods for increasing the quality factor or the frequency of operation can be also applied, if desired, for further improving the parameters of the invention.

Moreover, the proposed invention can be combined with the traditional inductors if required, in particular as a connection in series, connection in parallel or combination of them.

In other words, a technical effect is generated by the so-called "margarita shape" consists in that said shape gives a higher inductance and quality factor than a square shape.

The margarita-shaped inductor according to this invention may consist of one or more turns and one or more layers.

Two consecutive layers are connected together using vias.

A margarita-shaped inductor according to this invention is fabricated in the same way as the traditional inductors, that is, by a continuous metal track. It is wise to use the top metal for the reasons mentioned earlier regarding the traditional inductors. The width of the metal track can be constant or variable and, as with the total length, may have any value.

In a further embodiment of the margarita-shaped inductor according to this invention, the open part of each petal faces the center of the inductor.

In a still further embodiment of the invention, each petal is turned to an angle in respect with any precedent and the petals are connected along a virtual closed curve, which defines the turn of the inductor.

In a yet further embodiment of the invention, petals are connected together by circular segments. Any other curved or even straight path may be used for their connection.

In a specific embodiment of the invention, the number of petals in a margarita-shaped inductor according to this invention is equal to or greater than two.

The present invention further relates to a method for manufacturing an integrated or printed margarita shaped inductor wherein the integrated or printed margarita shaped inductor is fabricated in any method, respectively wherein the integrated or printed margarita shaped inductor is fabricated to any metal layer and any type of metal offered by the process.

The proposed shape can thus be fabricated in any fabrication process with no special fabrication steps required in any metal layer available by the said process.

The accompanying drawings are included to provide a further understanding of the invention, and are incorporated in and constitute a part of this specification. The drawings illustrate embodiments of the invention and, together with the description, serve to explain the principles of the invention.

DESCRIPTION

The device described hereafter will be, for the sake of simplicity, considering the design of integrated inductors only. Since designing printed inductors is similar to that of integrated ones, with the latter to be more complex as more steps and parameters are introduced during the fabrication process. Their design on PCBs directly emerges from their design in integrated circuits.

Figure 1:
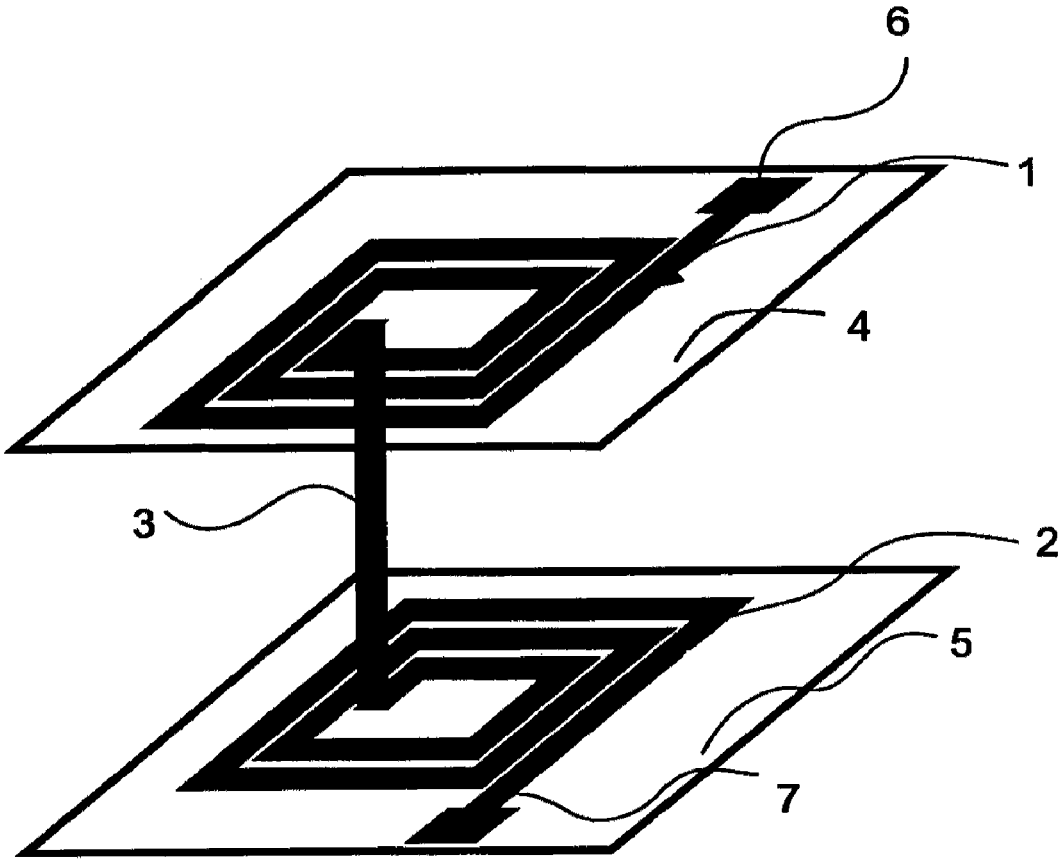
FIG. 1 shows a three dimensional drawing of a classic square inductor of 2.5 turns and 2 layers.
Figure 2:
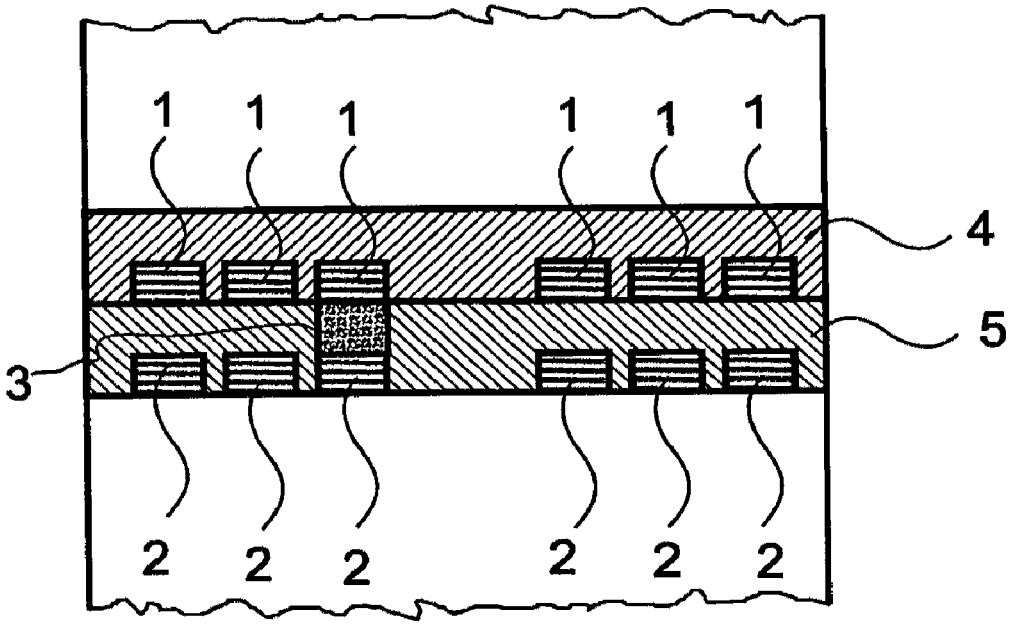
FIG. 2 is a cross-section of FIG. 1.

The design of integrated inductors up to now mainly consists of connecting in series two or more inductors of single or multi-turn which are designed in the different metal layers provided by each technology, as shown in FIG. 1, where a square inductor of 2.5 turns and two layers is depicted. FIG. 2 illustrates the cross-section of FIG. 1 maintaining the same numbering for ease of reading. Each layer consists of a continuous spiral metal track 1, 2 forming the inductor turns. Different metal layers are isolated from each other by oxide layers between them 4, 5. As shown in FIG. 1, the series combination of inductors is achieved by the so-called vias 3 provided by each technology. Vias are vertical metal lines connecting two adjacent metal layers. The two free ends 6, 7 of the continuous track, formed by the inductors connected in series, are the ports of the entire inductor. The inductor design almost always starts from the top metal layer, since most of the technologies provide a special metal for this purpose, while by this way a better isolation from the substrate is achieved.

Figure 3:
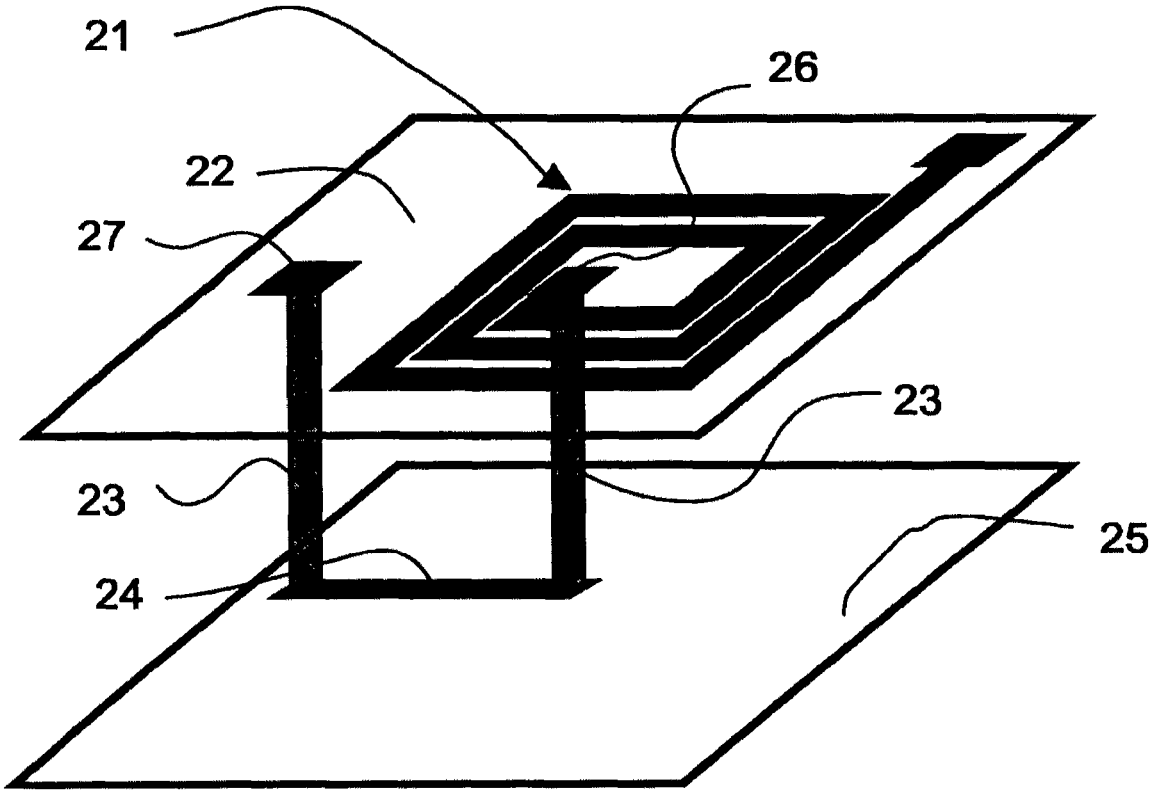
FIG. 3 illustrates an example of using underpass to a single layer square inductor of 2.5 turns.

FIG. 3 shows the specific case of a one layer and 2.5 turn inductor 21, designed at one layer 22, where a metal track 24 at a different layer 25 is used, to connect the port inside the inductor 26, with a point outside of it 27. The connection of the metal line with the two connecting points is achieved by use of vias 23. Such a line which connects two coplanar points in general, but resides in a different—usually the lower next—layer is called underpass. Two points are connected with underpass when the direct (coplanar) connection would short circuit other points in the chip.

Figure 4:
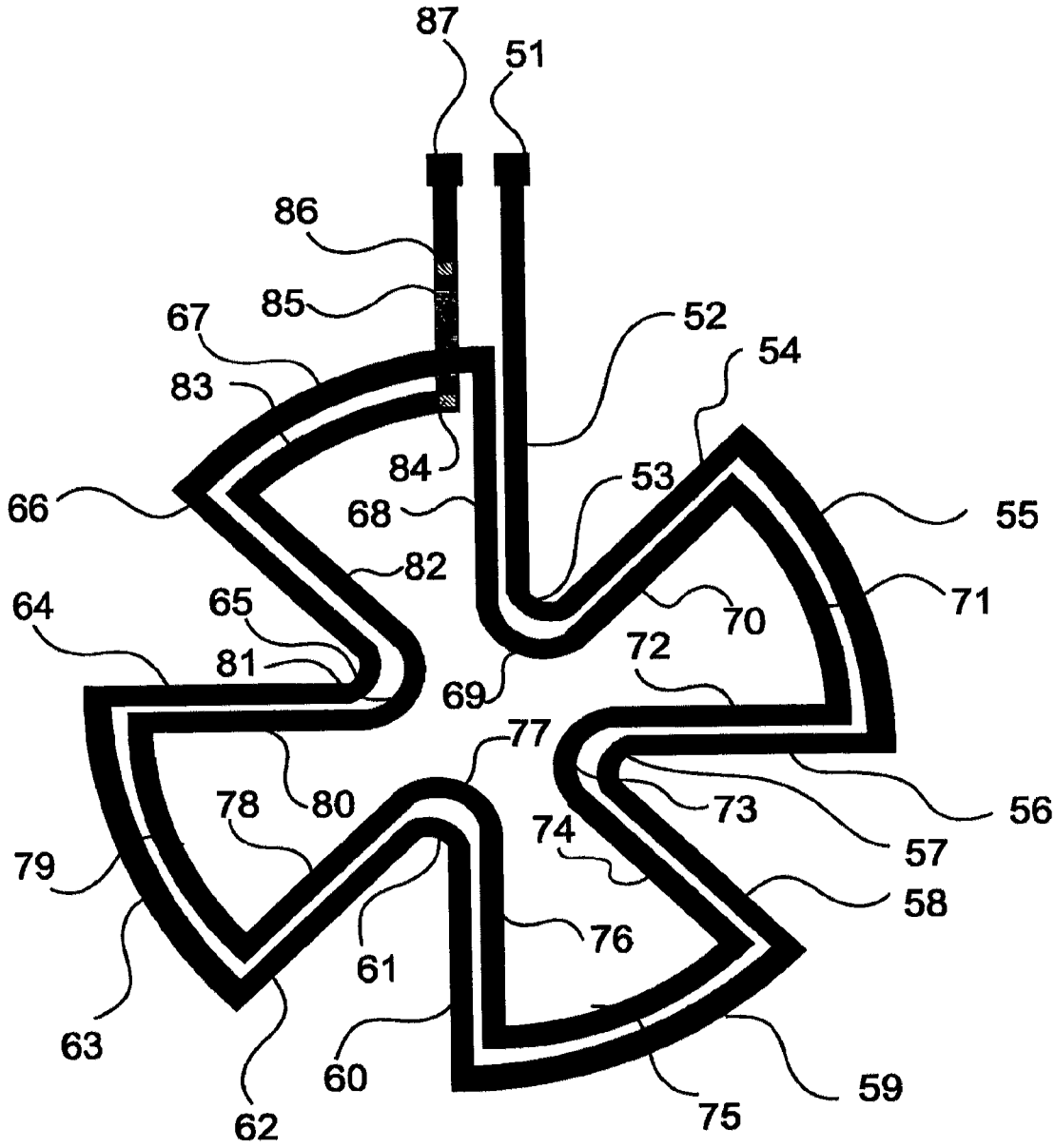
FIG. 4 is a plan view of a single layer 2-turn margarita-shaped inductor, according to this invention.

As shown in FIG. 4, the outer turn, also called as the primary or the first, consists of the continuous track 52-68, while the inner, or second, turn, consists of the continuous track 69-83. The petals of the first turn comprise the continuous tracks 54-55-56, 58-59-70, 62-63-64 and 66-67-68, connected consecutively through the segments, 57, 61 and 65 respectively. The petals of the second turn comprise the continuous tracks 70-71-72, 74-75-76, 78-79-80, 82-83, connected through the segments 73, 77 and 81 respectively. The connection between the two turns is achieved by segment 69. The margarita-shaped inductor according to this invention has two ports 51 and 87 just as the traditional inductors. Port 87 is connected with the second turn through underpass 85 which is connected with the second turn and the connector using vias 84 and 86 respectively.

Both the total length and the shape of each petal may be different from the other ones, but for maximum performance all the petals should be identical.

Each turn encloses every inner turn and each petal encloses every inner petal respectively. It is understood that a deviation from the above is possible but in this case underpass is required, which unnecessarily increases the complexity of the design. Any number of continuous or non continuous petals, may be omitted, by connecting the corresponding petals located right before and right next of every group of consecutive petals omitted. If the connection is not possible on the same layer without short-circuiting other petals, it can be achieved in a different layer using underpass. For maximum overall performance, the choice for the petal shape must take into consideration the following conflicting design restrictions: each petal to be located as far as possible with each other, to enclose the largest possible area, to have the smallest total length and the total surface area occupied by the overall margarita-shaped inductor be the minimum one. Thus, referring to FIG. 4 and in particular to the petal 54-55-56, the best shape of the petal is composed by two equal line segments 54 and 56, the rays, forming an acute angle and a circular segment 55 connecting two opposite ends of theirs. One way to obtain this design is to draw two concentric circles and take the closed loop defined by two radii of the circles forming an acute angle, and the circular sectors cut by the radii, removing the sector cut by the inner circle.

The best shape is composed by two equal line segments 54, 56 forming an acute angle, a circular segment 55. The effect produced by these features is as follows: the optimal shape for the petal is determined by complying with the following conflicting conditions. It must enclose the largest possible area—for the magnetic field to be stronger, on the one hand, it must have the minimum possible length and no acute angle should be formed—on the other hand, and the overall surface are occupied by the margarita inductor should be minimum due to cost reasons.

Each turn may consist of any number of petals. Due to the restrictions described in previous section, for best results, the maximum number of petals for each turn should not exceed four. For this amount, two consecutive rays form an angle of substantially 45°.

An effect is produced by an interaction of two consecutive rays, because the current flows in two opposite directions. Indeed, due to the opposite directions of the current flow, the mutual coupling between those rays is negative, thus producing in effect a negative mutual inductance. For this reason the distance between these opposite rays should be as long as possible. However, the positive mutual coupling due to each petal outperforms the negative one resulting in an positive total inductance.

If the design of circular segments or curved lines in general is not allowed by the technology, each curve is replaced by a combination of straight line segments in a way to approximate the curve. This can be achieved with any number of straight line segments and combination of angles. The best results are obtained however when the maximum angles allowed by technology are used and the smallest number of straight line segments.

Two consecutive petals are connected at the same layer using curved segments 57, 61, 65, 73, 77, 81. The selection of the shape of these segments itself is not crucial for the invention but some shapes contribute to the increase of the performance of the inductor. Acute angles, however, should be avoided in general, as they exhibit higher resistance and introduce negative mutual coupling compared to the obtuse angles. Although a circular arc is a good choice, due to design constrictions of the specific process. The shape shown in FIG. 1, which approximates the circular arc by consecutive line segments connected to an obtuse angle is proposed.

Hence, for example, for the typical technologies where the allowed angles between two segments are 0, 45°, 90° and 135°, the best combination for approximating any circular segment is two equal line segments forming an 135° angle.

Since the magnetic field of the inductor is strongest at its center, most designs propose the area around its center to be free of metal. Thus, in the proposed invention, a region centered on the center of the margarita-shaped inductor and with radius equal to about ⅓ of the radius of the virtual envelope circle of the inductor is left free of any metal. It is understood that any other value may be chosen, yet less than the radius of the outer circle.

Figure 5:
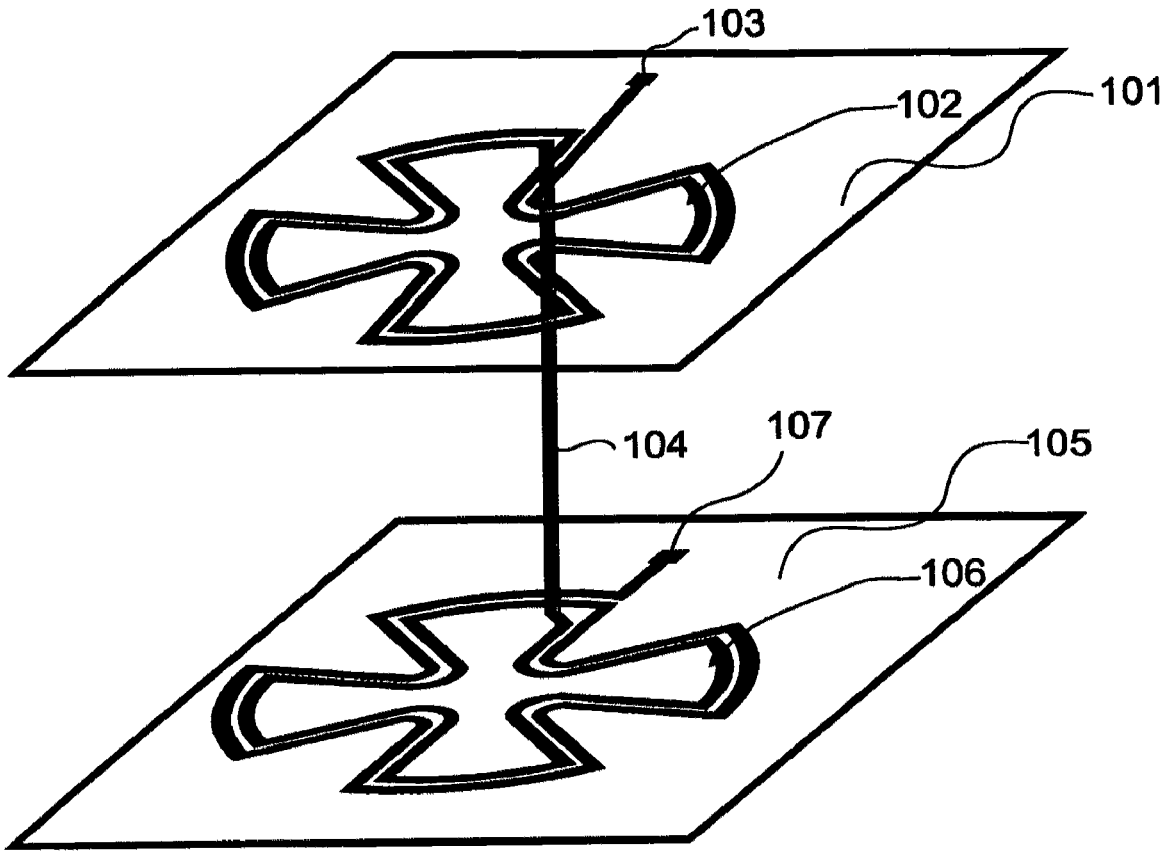
FIG. 5 depicts a three dimensional plan of a two-layer two-turn margarita-shaped inductor according to this invention, showing the use of vias.

A margarita-shaped inductor according to this invention may consist of several layers, as it is the case for the traditional inductors. The design can be either simple or alternative. In the simple design, each layer is designed in a different metal layer and two consecutive layers are connected each other using vias. Each layer may have a different number of turns and/or petals from the others, but for better results the number of turns and petals of each layer need to be equal. Referring to FIG. 5, the second turn 102 of one layer 101, is connected to the second turn 106 of an other layer 105 using vias 104, while the ports 103 and 107 of the inductor are located at these two different layers, respectively.

Figure 6:
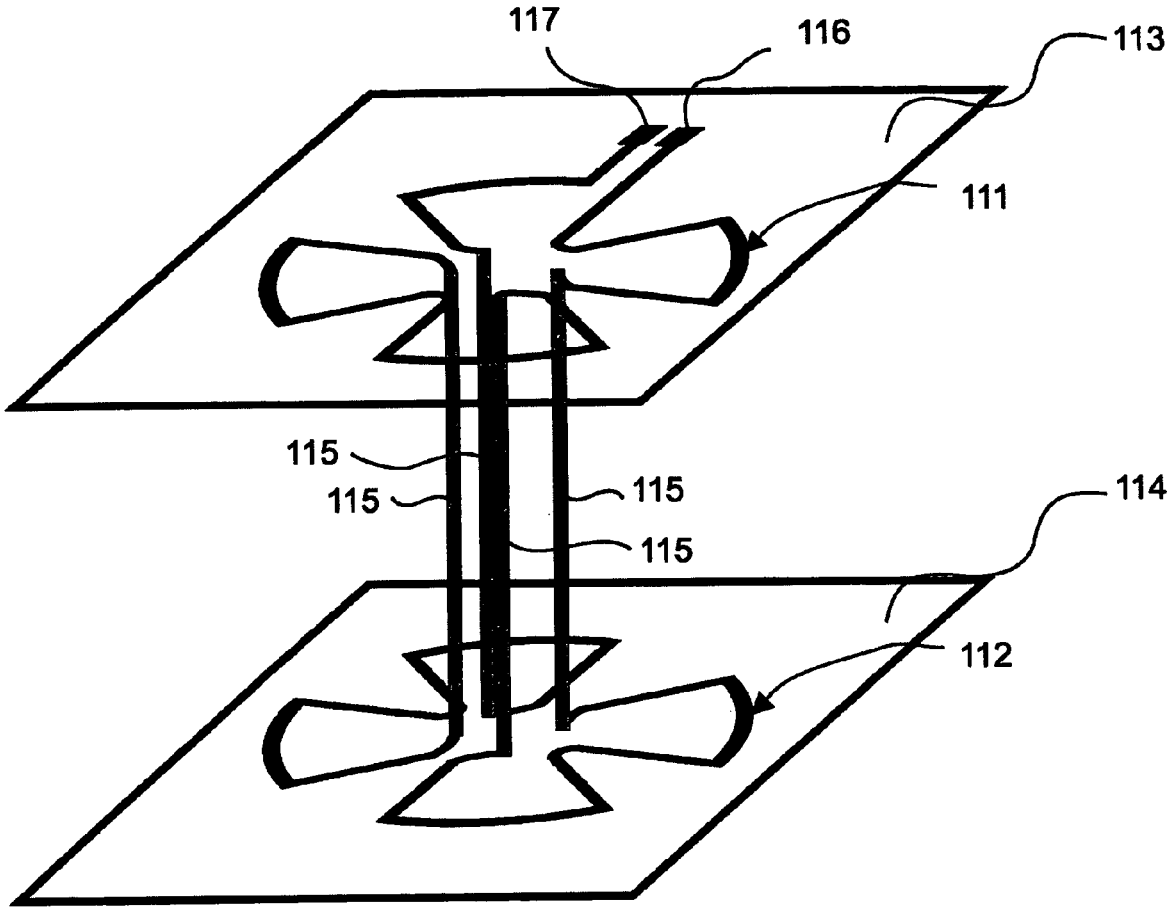
FIG. 6 shows a two-layer one-turn margarita-shaped inductor according to this invention, in alternative connection.
Figure 7:
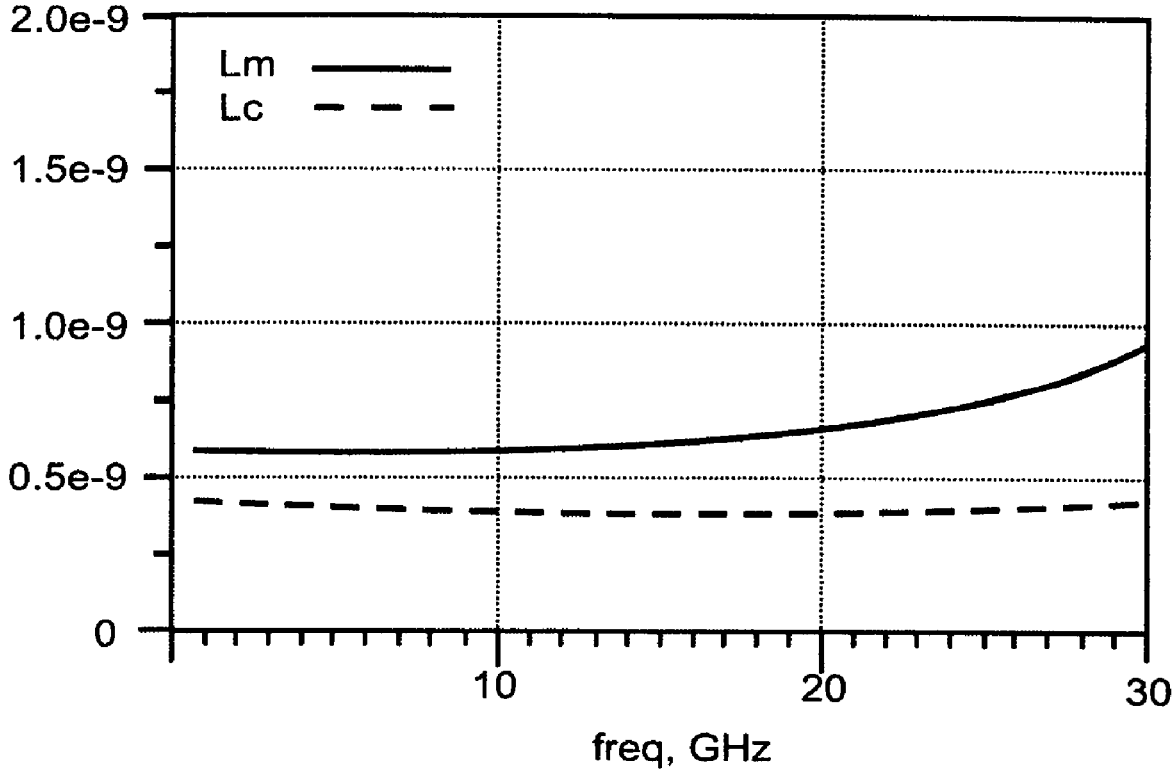
In FIGS. 7 and 8, a comparison of inductance L and the quality factor Q as a function of frequency of operation is depicted, between a traditional single-layer single-turn spiral inductor and a single-layer single-turn margarita-shaped inductor according to this invention.
Figure 8:
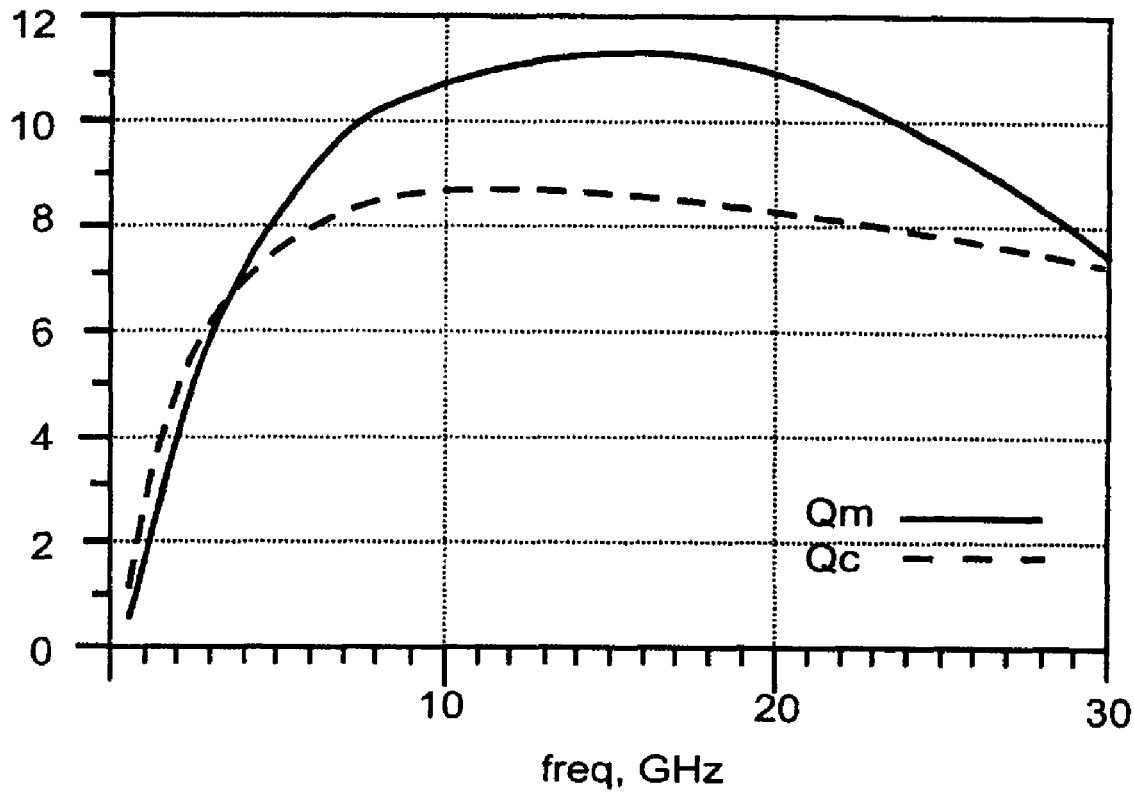
Figure 9:
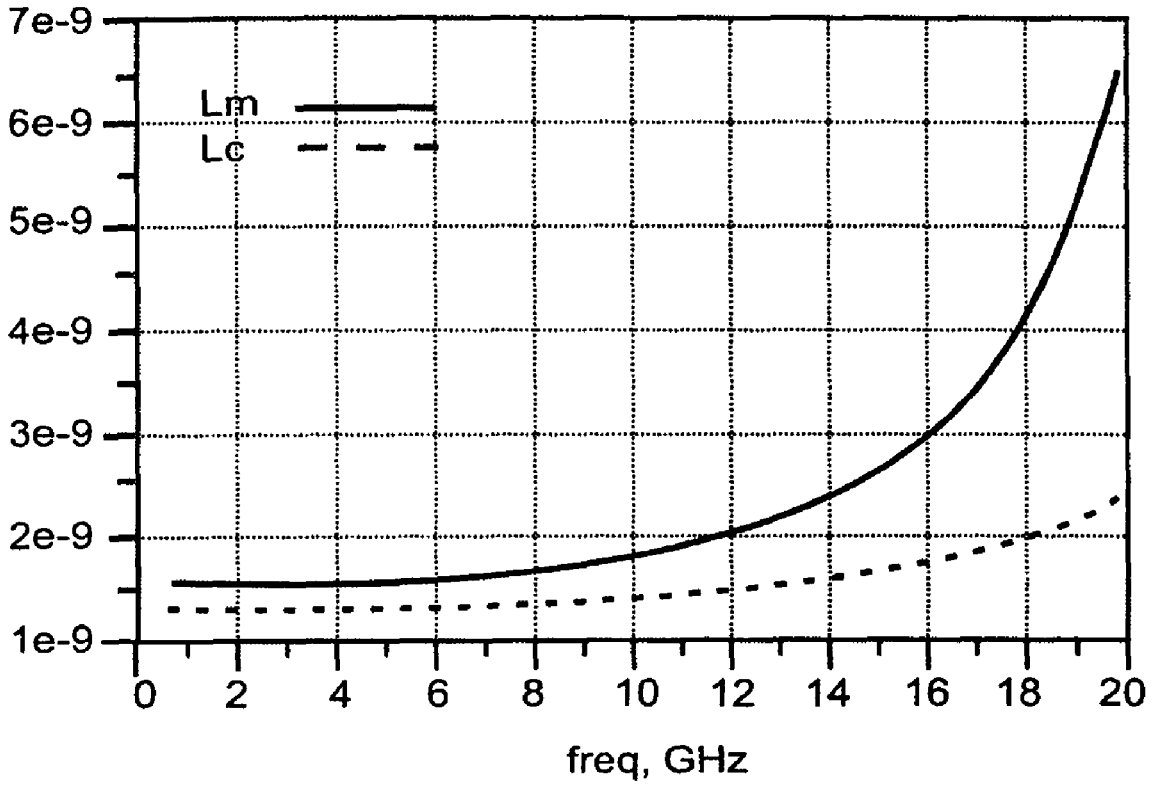
In FIGS. 9 and 10 a comparison of inductance L and the quality factor Q as a function of frequency of operation is depicted, between a traditional two-layer single-turn spiral inductor and a two-layer single-turn margarita-shaped inductor with alternative design according to this invention.
Figure 10:
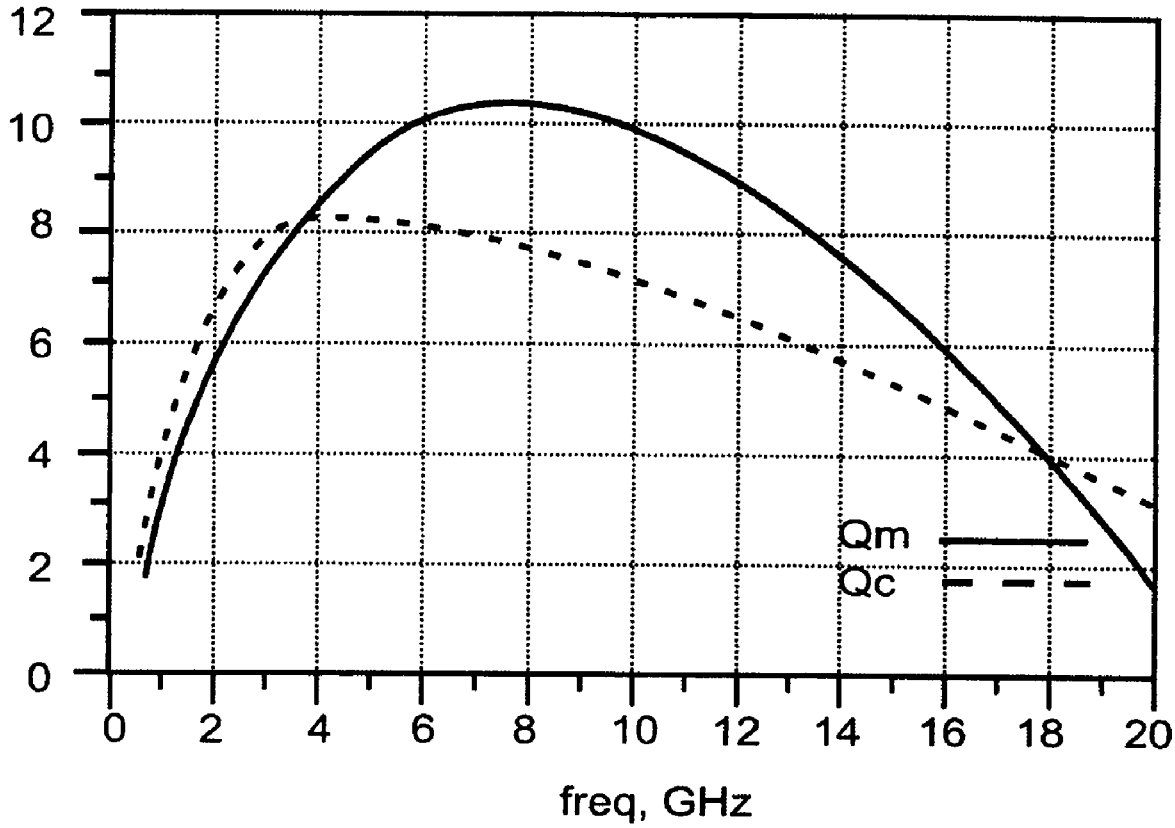

The alternative way for designing a multi-layer margarita-shaped inductor, according to this invention, is shown in FIG. 6. Here, the petals residing in the same layer are not all continuously connected as it was the case in FIG. 5. Instead, some petals of one layer are connected in series with some petals of another layer. With reference to FIG. 6, each petal of layer 113 is connected in series with another petal of layer 114. Since the petals which are being connected reside on different layers, vias 115 are used. Thus, for example referring to FIG. 6, the petal 111 is connected in series with petal 112. Two consecutive connected petals need not necessarily to be along the same perpendicular line and any desired combination of connections among the petals may be made. The disadvantage of this type of connection is that the complexity of design is increased to some extent, but on the other hand the characteristics of the integrated margarita-shaped inductor including quality factor and operating frequency are further enhanced because currents with the same frequency are created in each perpendicular line.

In FIGS. 7-10 two pairs of LQ versus frequency figures are given, clearly showing the superiority of the margarita-shaped inductor, according to this invention, compared to traditional ones generally those not having said innovative shape. The comparison is performed for all cases between two inductors occupying equal surface areas. Specifically, in FIGS. 7 and 8 the inductance and quality factor of two inductors versus frequency are shown respectively. The dotted line corresponds to a two-layer single-turn traditional inductor while the continuous line to a two-layer single-turn 4 petals margarita-shaped inductor, according to this invention, which occupies equal area on the chip with the traditional inductor, showing the significant improvement that exhibits compared to the traditional inductor which occupies equal area on the chip with the traditional inductor, showing the superior performance compared to the traditional inductor.

A margarita-shaped inductor, according to this invention, can be combined with traditional coils, namely to be connected in series or parallel, if desired.

Figure 11:
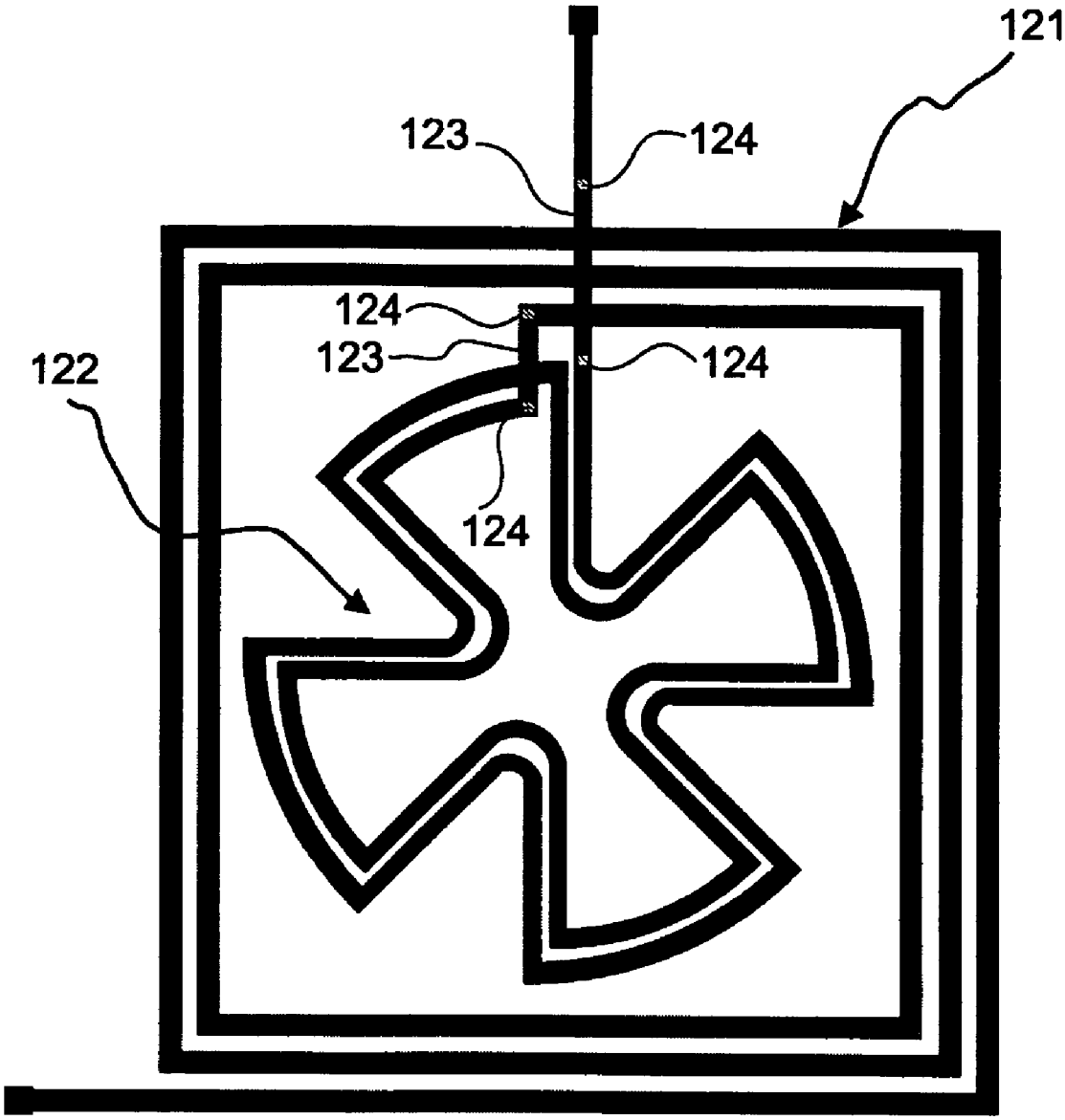
FIG. 11 shows a single-layer two-turn margarita-shaped inductor according to this invention, combined with a traditional square inductor of single layer and 2.5 turns.

With reference to FIG. 11, a traditional square inductor of 2.5 turns and one layer 121 is connected in series with a margarita-shaped inductor of two turns and one layer, according to this invention 122. It is obvious that the number of turns and/or layers of the traditional inductor may differ from those of the margarita-shaped inductor, according to this invention. The last layer of the traditional inductor is connected with the last layer of the margarita-shaped inductor. If these layers overlap without any short-circuit the connection may be made directly, otherwise, i.e. if the last layer of the traditional inductor does not coincide with the last layer of the margarita-shaped inductor or the direct connection will result to a short-circuit, the different layers are connected together using vias 124 and underpass 123.

Two integrated margarita-shaped inductors, according to this invention, can be connected to a transformer configuration in one or more layers as it is the case for the traditional inductors. One margarita-shaped inductor is defined as the primary inductor of the transformer and the other as the secondary. This selection can be made arbitrarily. The primary or secondary inductor may consist of more than one margarita-shaped inductor connected in series. The design of the transformer is made in such a way that the magnetic field of the primary inductor couples with that of the secondary, to obtain the transformer. This can be achieved by either stacking the inductors at different layers, or by designing the turns of the primary and secondary inductors in such a way that each one encloses another or finally by a combination of these two ways. This way is described by means of an example with reference to FIGS. 12 and 13 for each case respectively.

Figure 12:
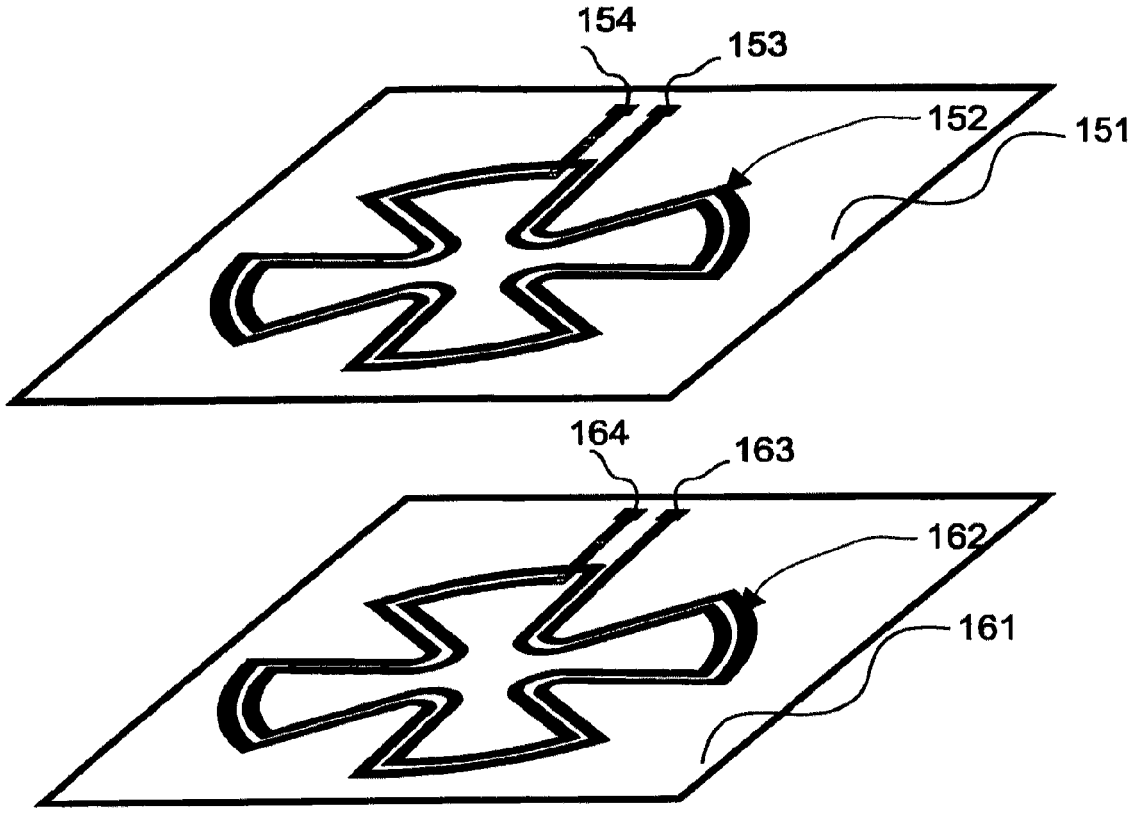
FIG. 12 illustrates two single-layer margarita-shaped inductors of two turns, according to this invention, connected as a transformer in two different layers.
Figure 13:
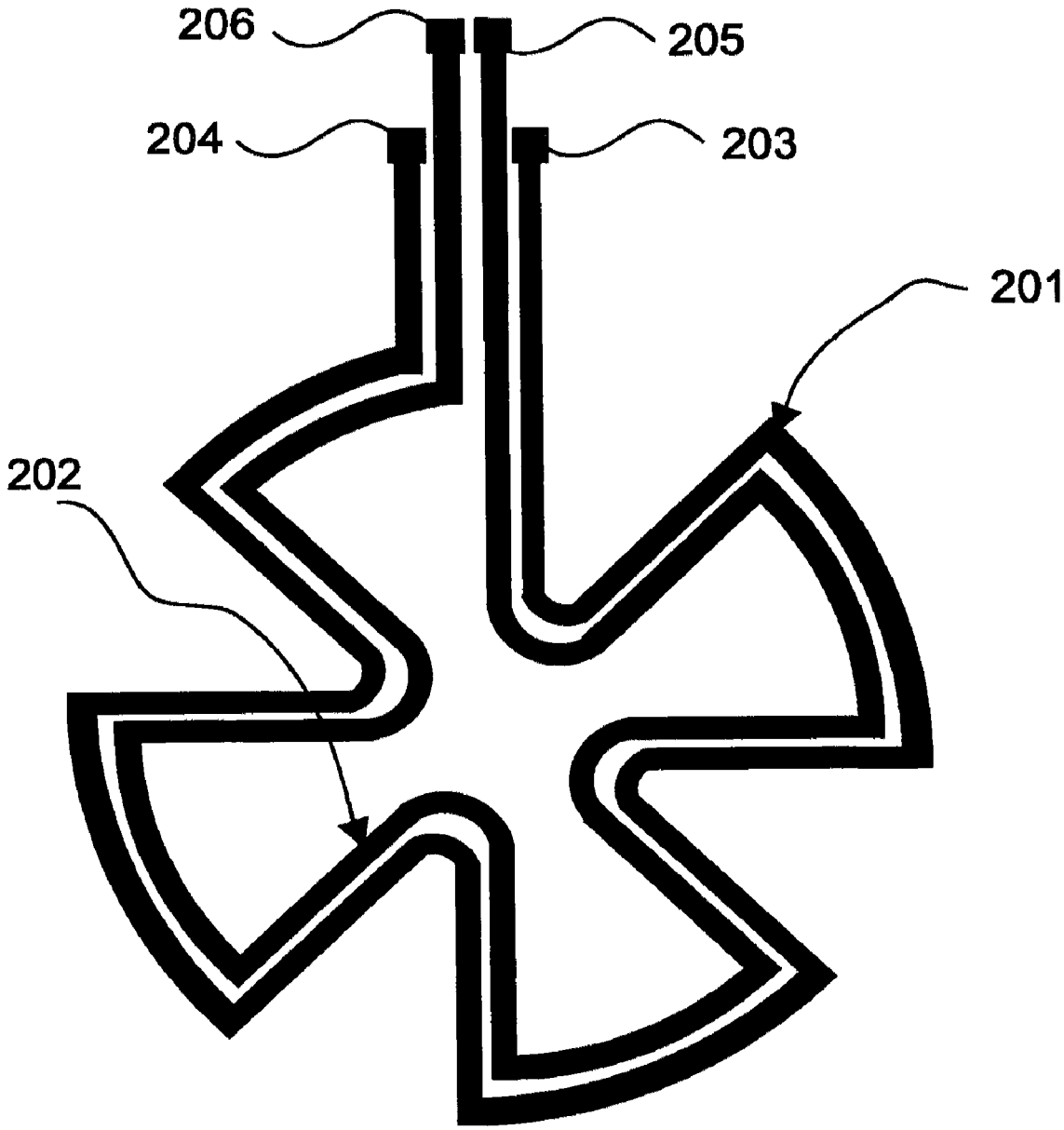
FIG. 13 illustrates two single-layer single-turn margarita-shaped inductors, according to this invention, connected as a transformer in the same layer.
Figure 14A:
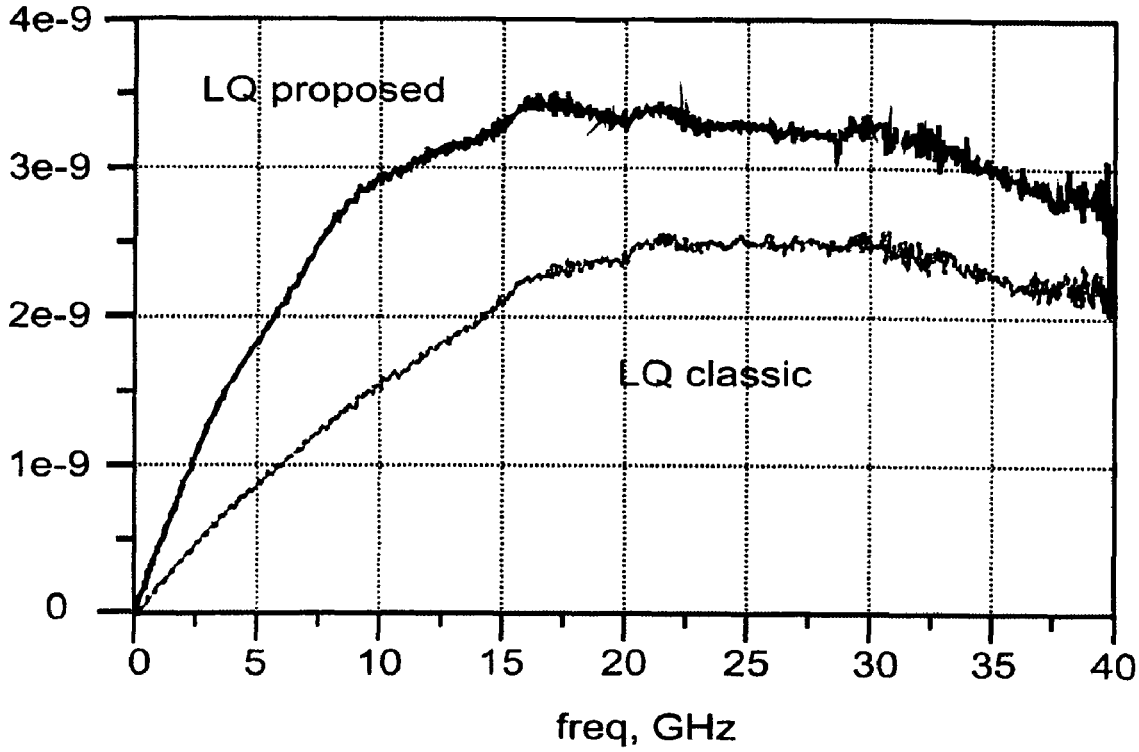
FIGS. 14*a* and 14*b* regard the design of the margarita shaped inductor in practice and the comparison between measurement results of a margarita and a typical octagonal inductor respectively.
Figure 14B:
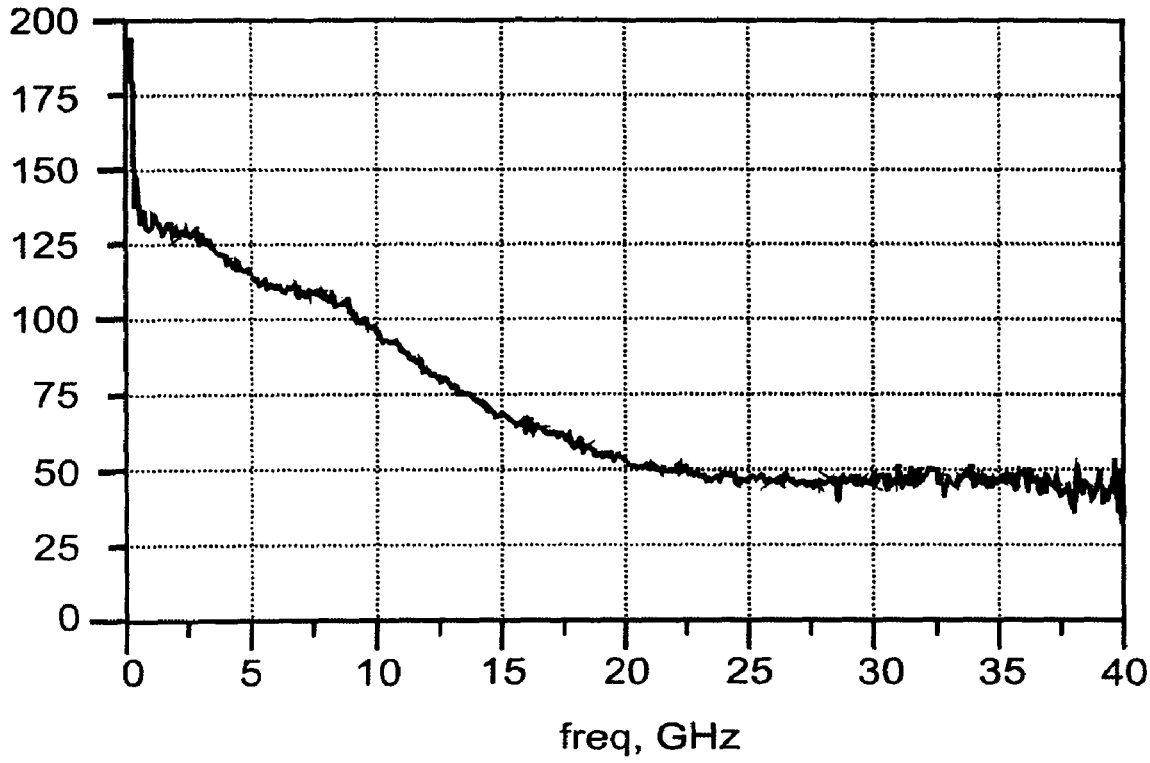
Figure 15:
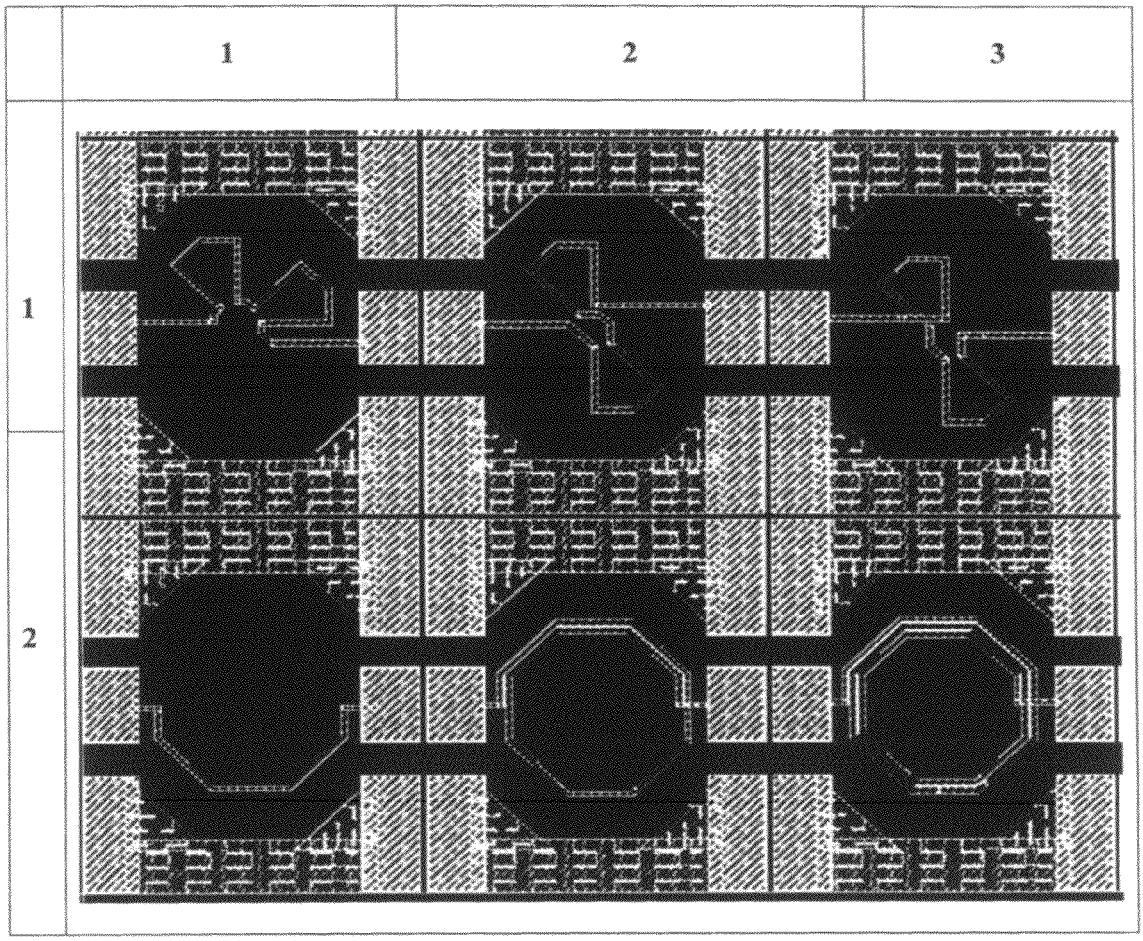
FIG. 15 shows a comparison between a margarita shape inductor of two petals and a typical octagonal one of 0.5 turn in a layout of the test chip fabricated.

Specifically, FIG. 12 shows the connection of two margarita-shaped inductors of one layer and two turns, according to this invention, in a transformer configuration, designing the two inductors at different layers 151 and 161. Referring to FIG. 12, the margarita-shaped inductors 152 and 162 are defined as the primary and the secondary inductors of the transformer, respectively. The ports of the primary and the secondary inductors are the 153, 154 and 163, 164 respectively. It is understood that the underpass used in each case should be designed at a different layer than those of the primary and secondary to avoid any short circuit due to underpass. This transformer design can be straightforwardly generalized for designs of more than two layers. FIG. 13 shows a transformer configuration using one layer. The transformer consists of two margarita-shaped inductors of one turn and one layer, according to this invention. The turns of the margarita-shaped inductors 201 and 202 are designed in such a way that one encloses another as shown in the Figure. If 201 and 202 are defined as the primary and the secondary respectively, the ports of the primary will be 203 and 204 while the ones of the secondary will be 205 and 206. In the case of more than one turns, where an underpass is required, the same discussed earlier regarding the case of the transformer configuration in two layers, applies here as well.

In FIG. 1 part of the layout of the test chip fabricated for testing the margarita shaped inductor is shown. At the second row typical octagonal inductors are depicted while at the first row three margarita shaped inductors of two petals connected in different ways are shown.

In FIGS. 2*a* and *b* a comparison between the measurement results of the 0.5 turn octagonal inductor ($2^{nd}$ row-$1^{st}$ column) and the margarita shaped inductor of two petals ($2^{nd}$ row-$2^{nd}$ column) is presented. Specifically, in FIG. 2*a* the product inductance times quality factor (L*Q) as a function of frequency for both inductors is depicted, while in FIG. 2*b* their relative difference is presented. As it can be seen, the margarita shaped inductor outperforms the octagonal one.

It is further to be understood that the scope of the invention further includes all embodiments which may be defined as an inductor, in particular of the integrated or printed type, comprising a plurality of open loops with a predetermined shape connected in series along a virtual path around a virtual geometrical centre, each loop having two ends with their respective open side located between both said ends, thereby facing said fictive centre, characterized in that said open loops are mutually connected at their said ends belonging two adjacent loops, thereby facing said centre, wherein each said loop is mutually rotated over an angle $\alpha$ respective the adjacent loop around geometrical centre.

The abovementioned best embodiment with maximum 4 loops is suitably represented or symbolized by a clover shape wherein the aforementioned petals of the shape proposed according to the invention actually form the leaves of the clover like shape. In other words, the shape as proposed according to the invention may equally be designated by a clover like shape in the embodiment with maximum 4 loops, (including 3) which constitutes an alternative representation of the inductor specifically shaped according to the invention.

In addition, thanks to the incorporation of said clover shaped inductor in the whole circuit, the performance of said complete circuit like an LNA or a GPR receiver or a transceiver is generally improved.

The invention claimed is:

1. An inductor, in particular of the integrated or printed type, comprising a plurality of open loops with a predetermined shape connected in series along a path around a geometrical centre, each loop having two ends with their respective open side located between both said ends, thereby facing said centre, wherein said open loops are mutually connected at their said ends belonging to adjacent loops, thereby facing said centre, wherein each said loop is mutually rotated over an angle respective to the adjacent loop around said geometrical centre.

2. An integrated or printed inductor, in particular according to claim 1, wherein each open loop has a petal-like shape inductor the plurality of open loops comprising a set of petals, wherein the petals are connected in series along a path to form inductor turns and each petal is turned at an angle to each preceding petal and the open part of each of the petals faces the centre of the inductor.

3. The inductor according to claim 2, wherein the number of petals is equal to or greater than two, wherein all said loops have a identical shapes.

4. The inductor according to claim 3, wherein the number of petals is equal to or smaller than four.

5. The inductor according to claim 2, wherein each said open loop has a substantially curved like shape around said centre, in particular with an elongated profile, at least slightly, wherein said junction portions have an inwardly curved profile facing said centre.

6. The inductor according to claim 5, wherein each petal-like shape inductor has a combination of straight line segments connected by angles in a way to approximate a curve.

7. The inductor according to claim 6, further comprising maximum angles and a small number of straight line segments.

8. The inductor according to claim 2, wherein each said petal-like shape open loop has a substantially trapezoidal shape pointing at said centre with an elongated profile, wherein junction portions between open loops have inwardly curved profiles facing said centre.

9. The inductor according to claim 2, whereby the inductor has a generally symmetrical overall shape with respect to said centre and said loops are arranged substantially in a plane.

10. The inductor according to claim 2, wherein it the inductor comprises more than one layer, wherein the petals of each layer are connected in series and layers are connected to each other using vias, wherein the number of turns and petals of each layer are equal.

11. The inductor as defined in claim 10, wherein said inductor is incorporated in a complete circuit such as an LNA or a GPS receiver or a transceiver.

12. The inductor according to claim 2, whereby the inductor further comprises inductors connected together in series, in parallel or in combination thereof.

13. The inductor according to claim 2, wherein the inductor is connected as a transformer.

14. The inductor as defined in claim 13, wherein said inductor is incorporated in a complete circuit such as an LNA or a GPS receiver or a transceiver.

15. The inductor according to claim 2, wherein the shaped inductor is fabricated in a process following the rules of each process.

16. The inductor according to claim 15, wherein shaped inductor is fabricated in any metal layer and any type of metal offered by the process.

17. The inductor as defined in claim 2, wherein said inductor is incorporated in a complete circuit such as an LNA or a GPS receiver or a transceiver.

18. The inductor according to claim 2, wherein in said petal-like shapes, each of said open loops delimitates the petal-like shape perimeter that further comprises at least three parts, a peripheral part extending arcuately and two adjacent parts extending radially therefrom toward said virtual centre.

19. The inductor according to claim 2, wherein the petal-like shape further comprises two substantially equal ray line segments forming an acute angle and a circular segment connecting two spaced outer ends of the ray line segment.

20. The inductor according to claim 2, wherein the inductor comprises more than one layer, wherein one petal of any layer is connected to any other petal of a different layer.

* * * * *